US006453825B1

(12) United States Patent
Sprave et al.

(10) Patent No.: US 6,453,825 B1
(45) Date of Patent: Sep. 24, 2002

(54) UNDERFRAME FOR A RAIL-BORNE VEHICLE FOR THE FREELY MOVABLE TRANSPORT OF LOADS

(75) Inventors: Klaus Sprave, Kaarst; Ralf Rode, Schwalmtal, both of (DE)

(73) Assignee: Atecs Mannesmann AG, Düsseldorf (DE)

( * ) Notice: Subject to any disclaimer, the term of this patent is extended or adjusted under 35 U.S.C. 154(b) by 0 days.

(21) Appl. No.: 09/648,510

(22) Filed: Aug. 25, 2000

(30) Foreign Application Priority Data

Aug. 25, 1999 (DE) ..... 199 41 119

(51) Int. Cl.[7] ..... B61D 1/00
(52) U.S. Cl. ..... 105/157.1; 105/164
(58) Field of Search ..... 105/72.2, 157.1, 105/167, 164

(56) References Cited

U.S. PATENT DOCUMENTS

| | | | | |
|---|---|---|---|---|
| 3,998,166 A | | 12/1976 | Morrison | 104/243 |
| 4,491,074 A | | 1/1985 | Ackermann et al. | 105/164 |
| 5,018,453 A | | 5/1991 | Kinard | 105/72.2 |
| 5,992,568 A | * | 11/1999 | Craig et al. | 105/72.2 |

FOREIGN PATENT DOCUMENTS

| | | | | |
|---|---|---|---|---|
| CH | 677908 A5 | * | 7/1991 | B61F/9/00 |
| DE | 31 03 538 | | 11/1983 | B61F/13/00 |
| DE | 83 21 430.5 | | 2/1984 | B65D/90/18 |
| DE | 3612542 A1 | * | 10/1987 | B61F/5/36 |

* cited by examiner

*Primary Examiner*—S. Joseph Morano
*Assistant Examiner*—Robert J. McCarry, Jr.
(74) *Attorney, Agent, or Firm*—Cohen, Pontani, Lieberman & Pavane

(57) ABSTRACT

The invention relates to an underframe for a rail-borne vehicle for transporting freely movable loads, more specifically the underframe of a railroad crane. The underframe has a plurality of curve-negotiating wheel sets which are accommodated in bogies and mounted in a running-gear frame for rolling on running rails. A supporting-wheel set including two supporting wheels is provided to selectively relieve the load on the curve-negotiating wheel sets. The supporting-wheel set is fastened to the vehicle so that the supporting wheels may be raised to a rest position above the running rails and lowered from the rest position to an operative position in which the supporting wheel rests with adjustable pressure on the running rails.

10 Claims, 1 Drawing Sheet

UNDERFRAME FOR A RAIL-BORNE VEHICLE FOR THE FREELY MOVABLE TRANSPORT OF LOADS

BACKGROUND OF THE INVENTION

1. Field of the Invention

The invention relates to an underframe for a rail-borne vehicle, more specifically a rail-borne crane, for transporting freely movable loads having a plurality of curve-negotiating wheel sets which are accommodated in bogies and mounted in one or more running-gear frames for rolling on the running rails.

2. Description of the Related Art

In general, rail-borne vehicles are distinguished by the fact that they can be transported quickly and simply on rails to their places of use where they are then maneuverable Win a freely movable manner even with suspended load. Vehicles of this type include, for example, railroad cranes which are used in track laying, bridge construction, and as breakdown cranes. Railroad cranes are required to be transportable quickly on the rails to the place of use and must often be able to maneuver large loads in a very confined space.

Rail-borne cranes or other rail-borne vehicles with high working loads require a correspondingly large number of wheel sets so that the dead weight of the vehicle and the working load may be transferred to the rails without overloading the individual contact points of the wheels with the rails. The conventional wheel sets of the rail-borne crane must be arranged in pairs on bogies so that the rail-borne vehicle is capable of negotiating curves. Accordingly, the use of a large number of conventional wheel sets is not only expensive and increases the overall vehicle length, but also increase the unladen weight of the vehicle. The unladen weight of the vehicle, however, cannot be indefinitely increased as desired, for limits are set by the specifications of the operators of the railroad network and by the loading capacity of the running rails and of the subsoil. The working load which is added to the dead weight of the vehicle is thus also limited by the same constraints. Every increase in the dead weight of the vehicle ultimately means a reduction in the working load capacity.

Attempts therefore have to be made to keep the dead weight of the vehicle as low as possible in favor of the working load. German Patent 196 54 521, for example, proposes to split up the vehicle frame, extending over the entire vehicle length, and thereby make it lighter. However, making the vehicle frame lighter may have an adverse effect on the stability. Therefore, other ways have to be sought to increase the lifting capacity of the vehicle of the generic type.

SUMMARY OF THE INVENTION

The object of the present invention is to provide an underframe for a rail-borne vehicle for transporting freely movable loads which achieves high working loads with good maneuverability of the vehicle without greatly increasing the dead weight of the vehicle and is simultaneously cost-effectively manufactured.

The object according to the present invention is met by relieving the load on the conventional wheel sets of the vehicle with at least one supporting-wheel set consisting of two supporting wheels. The supporting-wheel set is fastened to the vehicle so so that it can be raised to a rest position above the rail and lowered from the rest position into an operative position in which each supporting wheel rests with adjustable pressure on one of the rails.

It was hitherto possible to increase the freely movable working loads of a vehicle of the generic type by increasing the amount of conventional wheel sets with a correspondingly high dead weight and extension of the entire vehicle. The increase in the working load is made possible by the present invention without extending the length of the underframe because the supporting-wheel sets relieve the permenent wheel sets of load during the load application, i.e., when a load is supported by the vehicle. The supporting wheels of the supporting-wheel set or the supporting-wheel sets are lowered onto the rails in a simple manner and absorb some of the working load, for which a separate twin wheel set would otherwise have been necessary. During the rail transport of the rail-borne vehicle, the supporting-wheel set is raised and the vehicle moves on the conventional wheel sets and may be taken to the place of use at high transport speeds. The degree of load relief of the conventional wheel sets at the place of use may be determined by setting the bearing pressure of the supporting-wheel set on the rail between 0 and a maximum (for example 17 t). Furthermore, a corresponding control may be provided so that the percentage of the load to be absorbed by the supporting-wheel set is maintained.

The supporting-wheel set may be arranged on the running-gear frame directly adjacent to one of the conventional wheel sets, the supporting wheels preferably having a smaller diameter than the wheels of the conventional wheel sets. The use of smaller wheels saves weight and space for accommodating the supporting-wheel sets, of which preferably at least two are provided on both sides of the vehicle.

According to an embodiment of the present invention, the supporting-wheel set is arranged between the conventional wheel sets of the underframe. A suitable solution is to arrange the supporting-wheel set in the region below the pivot of the bogie, since the load relief of the wheel sets is at its most effective there.

In a refined embodiment according to the present invention, the supporting wheel set is arranged on a link and may be raised and lowered hydraulically or hydropneumatically. Appropriate pressure-medium cylinders are arranged between the link and the underframe proximate the supporting wheels, the supply of pressure medium being effected in a pressure-controlled manner to set the supporting load of the supporting-wheel set.

According to a further embodiment of the invention, the wheel pressures of the supporting-wheel set are separately adjustable on each side of the vehicle. The separate adjustability of the supporting wheels on opposite side of the vehice allows controlling each wheel according to loads individually recorded during the maneuvering of the load.

In another embodiment of the present invention, the supporting wheels of each supporting-wheel set may be arranged individually on wheel-guide levers which are then in turn connected to the pressure-medium cylinders of the hydraulic system or hydropneumatic system.

To compensate for differences in radii of each wheel set when passing through curved sections, the supporting wheels of each supporting-wheel set may be mounted so as to be displaceable in the axial direction.

In an alternative embodiment, the supporting wheels may be driven for providing mobile assistance when moving the vehicle under load.

The present invention provides an under frame with high lifting capacities that is short and cost-effective. The high lifting capacity is achieved with simple means which enable the forces which act on the conventional wheel sets from the working load to be distributed over at least one additional supporting-wheel set when the vehicle is moving under load to either relieve the load on the conventional wheel sets of the vehicle or to increase the lifting capacity of the vehicle. The supporting wheels may of course also be arranged in a larger number at suitable points of the underframe. The measures are simple and save weight compared with the additional of further conventional wheel sets so that a favorable solution is obtained for the crane operator.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawing, wherein like reference characters denote similar elements throughout the several views.

DETAILED DESCRIPTION OF THE PRESENTLY PREFERRED EMBODIMENTS

Figure 1:
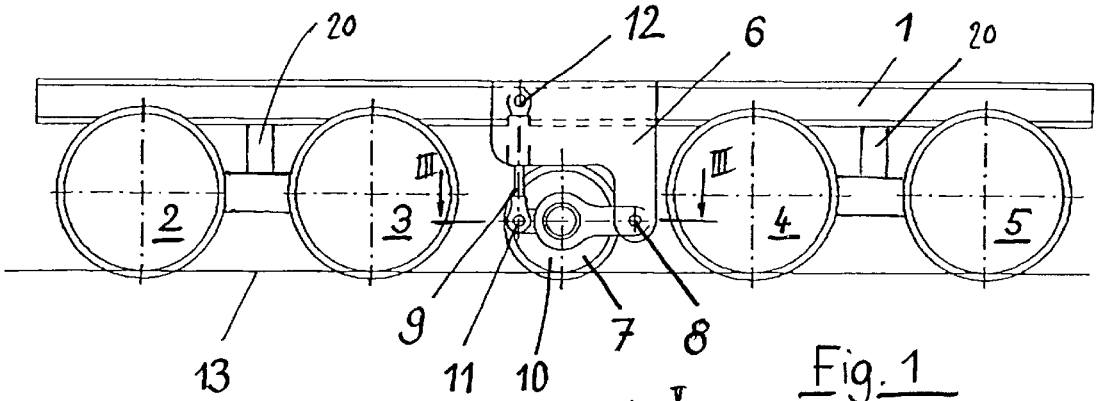
FIG. 1 is a side view of an underframe of a rail-mounted crane according to an embodiment of the present invention with a lowered supporting-wheel set.

FIG. 1 shows an underframe of a rail-mounted crane or other rail borne vehicle having four conventional wheel sets 2 to 5 supporting a running-gear frame 1. The railmounted crane normally has a plurality of conventional wheel sets which are combined to form groups of wheel sets mounted in bogies 20, thereby allowing the rail-mounted crane to negotiate curves of the track.

Figure 2:
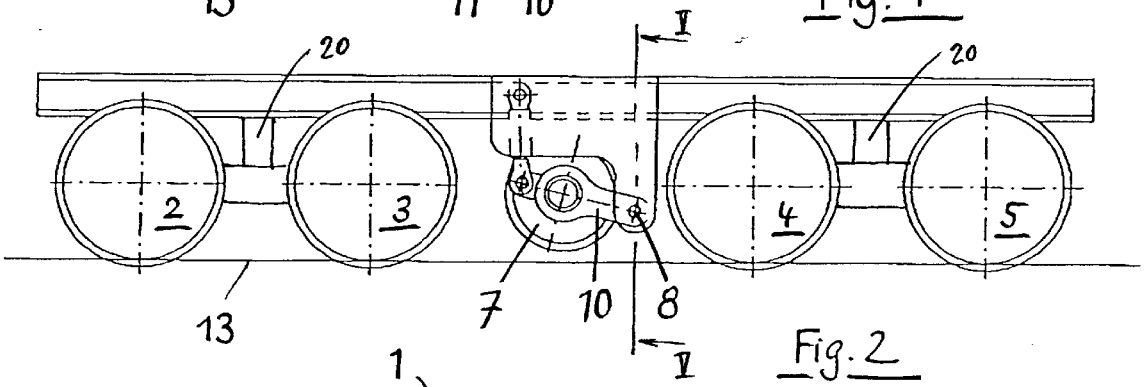
FIG. 2 is a side of the underframe according to FIG. 1 with the supporting-wheel set in a raised position.

A supporting-wheel set 7 is arranged on the running-gear frame 1 between the center two of the conventional wheel sets 3 and 4. The supporting-wheel set is mounted in a link 10 which is pivotable about a horizontal pivot axis 8 on a cross piece 6 fastened to both sides of the running-gear frame 1. Each link 10 is pivotally connected to a piston/cylinder unit 9 via a piston-rod-side lug 11 on the free end of each link 10. The other ends of the piston/cylinder units 9 are pinned to the running-gear frame 1 with cylinder-side lugs 12. By actuation of the piston/cylinder unit 9, the supporting-wheel set 7 may be pressed onto the rail 13 via the articulation point of the link 10, the articulation point being formed by the horizontal pivot axis 8, so that the four conventional wheel sets 2 to 5 are relieved of load by the supporting-wheel set 7. By admission of fluid to the piston/cylinder unit 9 in the opposite direction, the supporting-wheel set 7 mounted on the link 10, as shown in FIG. 2, may be raised during the pivoting of the link 10 about the articulation point 8 and lifted from the rail 13 in the process. The vehicle can be transported in this position without the supporting-wheel set 7 having a function.

Figure 3:
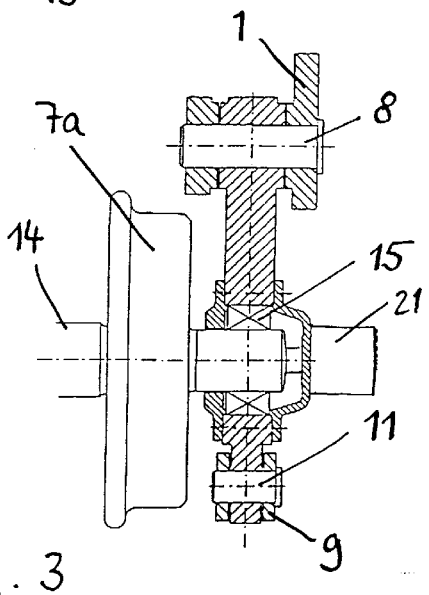
FIG. 3 is a sectional view of a supporting wheel of the supporting-wheel set in FIG. 1 along line III—III.

The mounting of the supporting-wheel set 7 through the link 10 is shown in FIG. 3 in a cross sectional view of link 10. A supporting wheel 7*a* of the supporting-wheel set is slipped into position on a common axle 14 with a second supporting-wheel (not shown). Some axial movement of the common axle 14 with the supporting wheels 7*a* is permitted by the bearing so that a compensation of the positions of the wheel is permitted when passing through a curved section of the rails. The axle 14 is mounted in a bearing 15 in the link 10. The articulation point of the piston/cylinder unit 9 comprises the piston-rod-side lug 11. FIG. 3 also shows an optional drive 21 for providing mobile assistance when moving a load.

Figure 4:
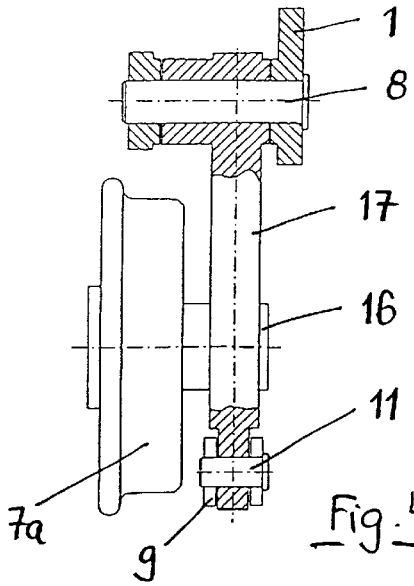
FIG. 4 is a sectional view of another embodiment of a supporting wheel similar to the view in FIG. 3.

Another embodiment of the supporting-wheel according to the present invention is shown in FIG. 4. In this embodiment, the supporting wheel 7*a* is mounted with an axle shaft 16 in a wheel-guide lever 17, which is pivotable about the horizontal pivot axis 8 on the underframe 1 similar to the pivting of link 10 in FIG. 3. As in the previous embodiment, the piston/cylinder unit 9 acts at piston-rod-side lug 11. In this embodiment, the supporting wheels 7*a* of the supporting-wheel set 7 may be moved individually in a displacement and force-controlled manner. Accordingly, tilt compensation on the opposite sides of the railroad crane may be effected via this embodiment.

Figure 5:
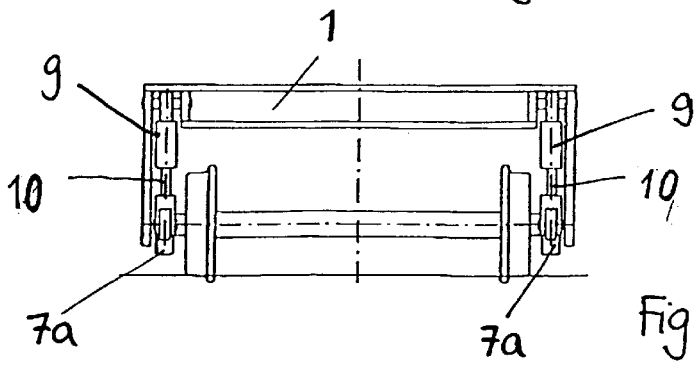
FIG. 5 is a cross-sectional view of an underframe in FIG. 2 along line V—V.

The arrangement of the supporting-wheel set 7 is shown in FIG. 5 in a cross section through the underframe. The supporting-wheel set 7 is fastened to the running-gear frame 1 directly adjacent to the wheels of the conventional wheel set 3 with the individual supporting wheels 7*a* of the supporting-wheel set being shown in the raised position.

The present invention enables a railroad crane to be transported with raised supporting-wheel set 7 in a train formation to the place of use. The overall length of the railroad crane may be kept relatively short because only the dead weight of the vehicle crane is to be transported. At the place of use, the supporting-wheel set 7 may lowered onto the rails 13 by actuation of the piston/cylinder unit 9 for absorbing some of the forces resulting from a load suspended and moved by a craone on the running-gear frame 1. Accordingly, the conventional wheel sets 2, 3, 4 and 5 are relieved of load to a significant extent. The supporting-wheel set 7 comprises a relatively small construction because the supporting wheels 7*a* are markedly smaller in diameter than the wheels of the conventional wheel sets 2 to 5 which are required to be large for high speed transport to the place of use. Accordingly, the supporting-wheel set 7 is lighter than a conventional bogie having two wheel sets. Accordingly, the underframe according to the present invention increases the lifting capacity without the otherwise marked increase in the dead weight.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. An underframe for a rail-borne vehicle for transporting freely movable loads, comprising:

a running-gear frame;

a plurality of curve-negotiating wheel sets accommodated in bogies for supporting said running-gear frame and rolling on running rails; and a supporting-wheel set comprising two supporting wheels, said supporting wheel set being operatively connected to said underframe for raising said supporting wheels to a rest position above the running rails and lowering said supporting wheels to an operative position in which said supporting wheels rest on the running rails to relieve the load on the curvenegotiating wheel sets, wherein a bearing pressure of said supporting wheels on the running rails in said operative position is adjustable for varying a degree of the load to be relieved.

2. The underframe of claim 1, wherein the supporting-wheel set is arranged on said running-gear frame directly adjacent to at least one of the plural curve-negotiating wheel sets.

3. The underframe of claim 1, wherein said supporting-wheel set is arranged between two adjacent ones of the plural curve-negotiating wheel sets of the underframe.

4. The underframe of claim 1, wherein the supporting-wheel set comprises two links articulated relative to the running-gear frame and respective means for selectively raising and lowering said links, said means comprising one of a hydraulic means and a hydropneumatic means.

5. The underframe of claim 1, wherein a pressure of each of said supporting wheels of said supporting-wheel set on the running rails is separately adjustable.

6. The underframe of claim 1, wherein said supporting wheels of said supportingwheel set are arranged on a common axle.

7. The underframe as claimed in claim 6, wherein said supporting-wheel set comprises wheel guide levers for supporting opposing ends of said common axle.

8. The underframe of claim 1, wherein the supporting wheels of said supporting-wheel set are axially displaceable.

9. The underframe of claim 1, wherein said supporting wheels are selectively drivable via a motor.

10. The underframe of claim 1, wherein the bearing pressure of each of said supporting wheels is individually controllable in said operative position so that a percentage of the load to be absorbed by said support wheels is maintained.

* * * * *